US005415575A

United States Patent [19]

Karls

[11] Patent Number: 5,415,575

[45] Date of Patent: May 16, 1995

[54] MARINE DRIVE PROPELLER CLUTCH

[75] Inventor: Michael A. Karls, Hilbert, Wis.

[73] Assignee: Brunswick Corporation, Lake Forest, Ill.

[21] Appl. No.: 248,694

[22] Filed: May 24, 1994

[51] Int. Cl.[6] ..... B63H 21/28

[52] U.S. Cl. ..... 440/75; 464/39; 192/55

[58] Field of Search ..... 440/75, 83; 192/55, 192/56 R; 464/38, 39

[56] References Cited

U.S. PATENT DOCUMENTS

| | | | |
|---|---|---|---|
| 2,062,593 | 12/1936 | McCloud | 464/39 |
| 2,185,457 | 1/1940 | Conover . | |
| 2,402,197 | 6/1946 | Kincannon . | |
| 2,477,521 | 7/1949 | Martin | 464/39 |
| 2,569,144 | 9/1951 | Benson . | |
| 2,633,923 | 4/1953 | Hartz . | |
| 2,751,987 | 6/1956 | Kiekhaefer . | |
| 3,880,267 | 4/1975 | Auble et al. | 192/55 |
| 4,778,419 | 10/1988 | Bolle et al. | 440/89 |
| 5,244,348 | 9/1993 | Karls et al. | 416/204 |

*Primary Examiner*—Jesus D. Sotelo

*Attorney, Agent, or Firm*—Andrus, Sceales, Starke & Sawall

[57] ABSTRACT

An apparatus and method is provided to release a propeller from the driving engagement of a propeller shaft when the propeller hits an object with sufficient force to otherwise cause damage to the marine drive. A clutch with first and second clutch members disengagably drives the propeller with a plurality of clutch teeth on one of the clutch members and a corresponding plurality of clutch sockets on the other. The clutch teeth and clutch sockets engage to provide a nonslip direct drive from the propeller shaft to the propeller and disengage to allow the propeller shaft to rotate free of the propeller when the propeller strikes an object. The clutch members are biased together such that the clutch teeth engage the clutch sockets during normal boating operation. The torque required to disengage the clutch may be adjustable by an adjustable retaining nut, or by using a spring of different compression rate, or by changing the characteristics of the clutch teeth or clutch sockets. Preferably, the torque required to disengage the clutch is set to a level just below that which would cause damage to the marine drive.

4 Claims, 2 Drawing Sheets

MARINE DRIVE PROPELLER CLUTCH

BACKGROUND OF THE INVENTION

The invention relates to marine drives, and more particularly to an apparatus and method to free a propeller from the driving engagement of the marine drive when the propeller strikes an object while boating.

Preventing damage to the marine drive, including the propeller, when the propeller strikes an object while propelling the marine drive and boat through the water, has been a long standing problem with numerous attempted solutions. For example, it was common practice in the industry to use a shear pin to release the propeller from the propeller drive shaft when the propeller struck an object to prevent damage to the marine drive. However, this solution required that a spare replacement shear pin be readily available because when the propeller struck an object and the shear pin broke, the marine drive would be disabled and would have to be removed from the water, the propeller hub disassembled and the shear pin replaced. This was troublesome, time consuming, and proved to be a source of consumer dissatisfaction.

Attempts were made at absorbing the shock and permitting slippage by the use of a helical spring, for example U.S. Pat. No. 2,185,457 issued to Conover Jan. 2, 1940, and U.S. Pat. No. 2,633,923 issued to Hartz Apr. 7, 1953. However, both these prior inventions required torque transfer through the helical spring which resulted in substantial losses of torque through torsional twisting of the spring and spring failures as a result.

Other attempts were made by Kincannon in U.S. Pat. No. 2,402,197 issued Jun. 18, 1946 and Benson U.S. Pat. No. 2,569,144 issued Sep. 25, 1951. Both Kincannon and Benson allow propeller slippage through a friction coupling. Kincannon uses several clutch and mating disks, a clutch plate, and the pressure created by the propeller to create a friction coupling which would disengage when the propeller strikes an object. Benson discloses a conical tapered hub and bushing constituting a friction clutch drive and uses a spring to couple the friction clutch. Benson and Kincannon rely upon a friction coupling to drive the propeller which not only wears relatively quickly, but also results in a degree of torque loss between the propeller and propeller drive shaft. Further, as the friction disks wear, the torque loss is greater and the threshold for slippage decreases which is undesirable.

Another attempt was made by Kiekhaefer in U.S. Pat. No. 2,751,987 issued Jun. 26, 1956 wherein the propeller hub is mounted on a plurality of rubber O-rings to offer limited propeller movement on the propeller shaft when the propeller strikes an object. However, Kiekhaefer transfers torque through the rubber O-rings wherein at least a portion of the torque is lost in torsional twisting or slippage of the rubber O-rings.

More recently, attempts have been made to use rubber or resilient bushings to absorb the shock of the propeller hitting an object. For example, U.S. Pat. No. 4,778,419 issued to Bolle et al. Oct. 18, 1988 and U.S. Pat. No. 5,244,348 issued to Karls et al. Sep. 14, 1993. While these systems absorb shock to a certain degree, beyond the shock absorbing capability, the rubber bushing or shock absorbing drive sleeve will slip at a point beyond the shock absorbing capability and be destroyed so that they need replacement.

SUMMARY OF THE INVENTION

The present invention overcomes the shortcomings of the prior art devices by providing an apparatus and method which comprises disengagably driving the propeller to the propeller shaft with a clutch assembly having first and second clutch members. One of the clutch members has a plurality of clutch sockets to receive a plurality of clutch teeth from the other clutch member to provide a nonslip direct drive. The present invention is free of the torsional losses and slippage that is associated with transferring torque through a spring or through friction pads.

The present invention allows free propeller shaft rotation when the propeller is stopped by an obstacle by disengaging the propeller from the propeller shaft with the use of a helical spring forward biasing the toothed clutch member into the socketed clutch member. The clutch teeth and clutch sockets have angled sidewalls to provide disengagement at a given torque level wherein the sidewall of the tooth slides up the sidewall of the socket thereby compressing the spring that forward biases the toothed clutch member. This sliding action continues if the propeller remains obstructed until the teeth are free from the sockets resulting in the propeller becoming free of the driving engagement of the propeller shaft. Once the propeller is free from the obstacle, the propeller is reengaged to the propeller shaft by the helical spring forward biasing the toothed clutch member into the socketed clutch member to renew the nonslip direct drive between the propeller and propeller shaft.

An object of the present invention is to provide a propeller clutch which is capable of releasing propeller shaft driving torque from the propeller when the propeller strikes an object, yet not have the torsional losses of transferring torque through friction pads or through a helical spring as in the prior art.

Another object to the invention is to provide a propeller clutch which is non-destructive and renewable regardless of the severity of impact of the propeller with an object.

Another object to the present invention is to provide a propeller clutch which can be adjusted to disengage at a desired torque level.

Yet another object of the invention is to provide a propeller clutch which is readily adaptable to existing marine drives.

Additional benefits and advantages of the present invention will become apparent from the subsequent detailed description of the preferred embodiment, the drawings, and the claims.

DETAILED DESCRIPTION OF THE PREFERRED EMBODIMENT

Figure 1:
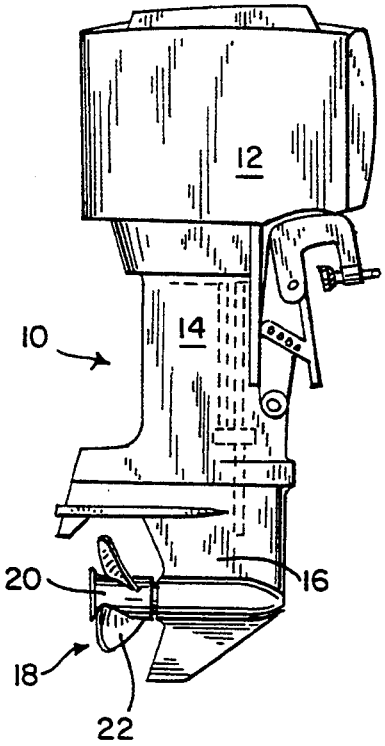
FIG. 1 shows a typical marine drive.

FIG. 1 shows a marine drive 10 having a power head 12, a mid-section 14 and a lower gearcase 16 having a propeller 18 extending rearwardly. Propeller 18 comprises a propeller hub 20 and radially extending propeller blades 22.

Figure 2:
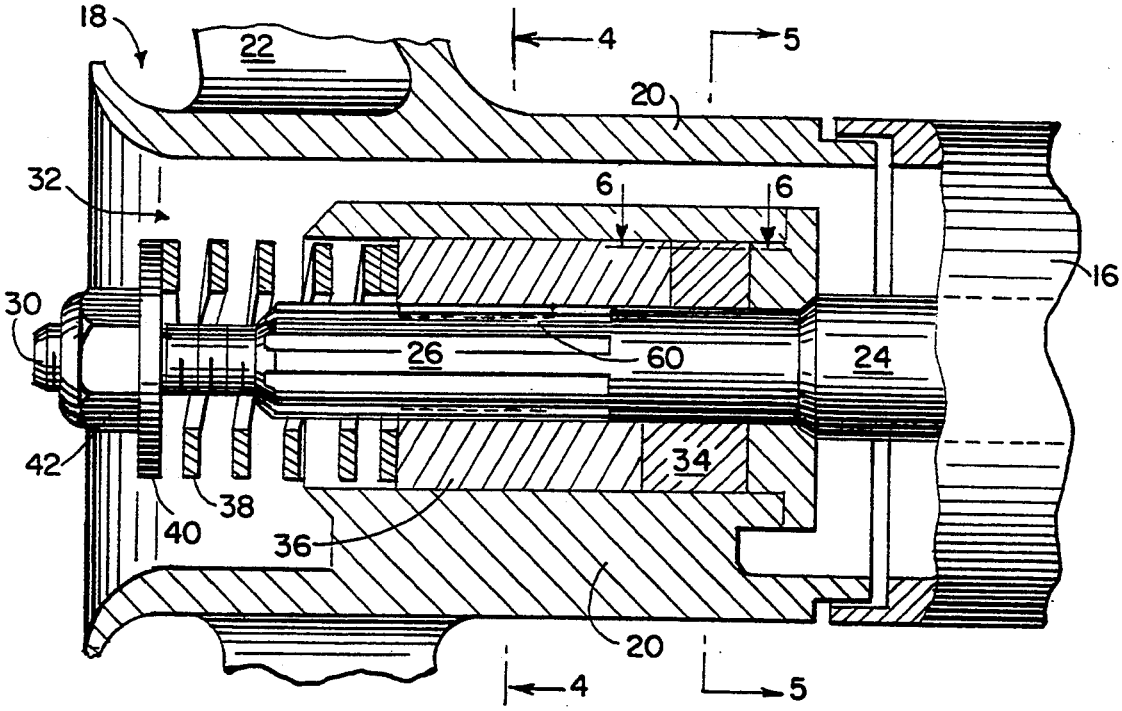
FIG. 2 shows a cross-sectional view of a portion of the structure of FIG. 1 in assembled condition.

Lower gearcase 16 has rearwardly extending propeller shaft 24, FIG. 2, having a splined portion 26 and a threaded end 30. Propeller hub 20 has a through-hub exhaust passage 32 for discharging engine exhaust rearward of the propeller. A propeller clutch comprises a first clutch member 34, a second clutch member 36, and a helical spring 38. The first clutch member 34 is interconnected with the propeller hub 20 in any of a number of ways. For example, first clutch member 34 may be keyed to hub 20, or retained with set screws or pins, or preferably made as an integral member of hub 20. Regardless of the method of attachment, first clutch member 34 is fixed with respect to hub 20. Second clutch member 36 is rearward of first clutch member 34 and has splined inner portion 37, FIG. 4, for slidably and drivingly engaging propeller shaft 24 at splined portion 26. Helical spring 38, FIG. 2, is rearward of second clutch member 36 and retained by washer 40 and retaining nut 42 which threadedly engages propeller shaft 24 at threaded end 30. Helical spring 38 forward biases second clutch member 36 against first clutch member 34.

Figure 3:
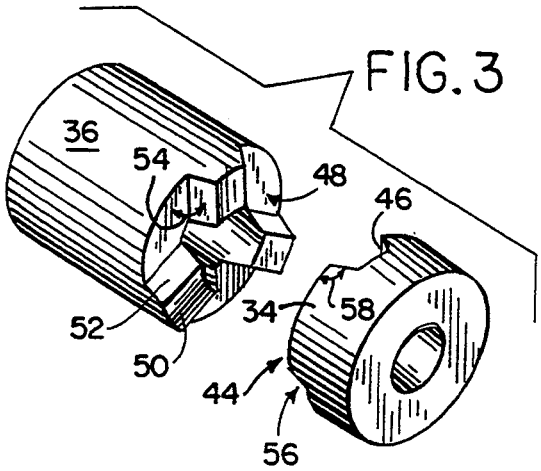
FIG. 3 shows an exploded perspective view of a portion of FIG. 1.

First clutch member 34 has clutching surface 44, FIG. 3, which comprises a plurality of clutch sockets 46. Second clutch member 36 has clutching surface 48 which has a plurality of clutch teeth 50 corresponding to the clutch sockets 46 of first clutch member 34. Clutch teeth 50 drivingly engage clutch sockets 46. Clutch teeth 50 have sidewalls 52 extending axially from clutching surface 48 and have angles of extension 54 as measured from clutching surface 48 to clutch teeth 50. Similarly, clutch sockets 46 of clutching surface 44 on first clutch member 34 have sidewalls extending axially from clutching surface 44 at an angle of extension 58 as measured from clutching surface 44. Preferably, clutch socket 46 has an angle of extension 58 equal to angle of extension 54 of clutch teeth 50 of the second clutch member 36.

Figure 4:
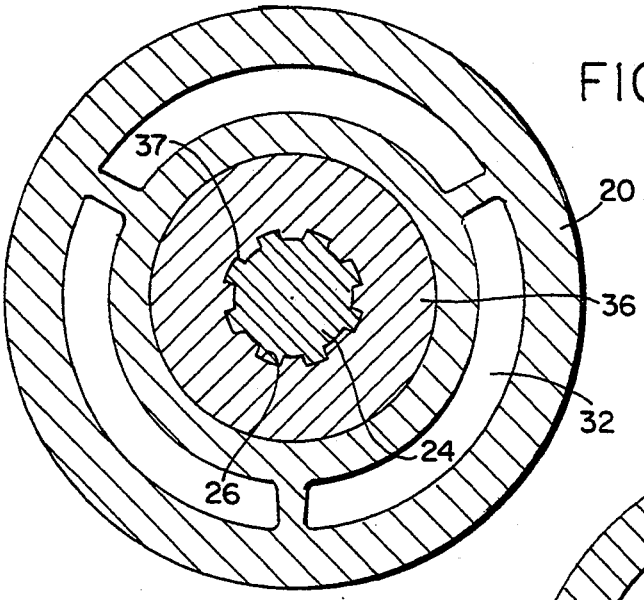
FIG. 4 is a sectional view taken along the line 4—4 of FIG. 2.
Figure 5:
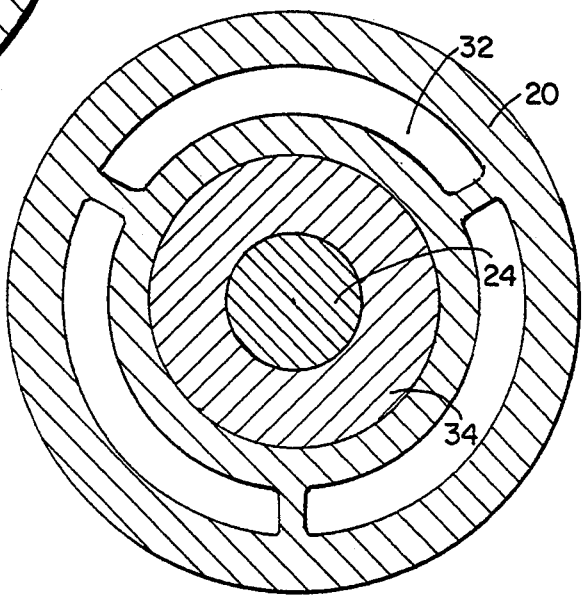
FIG. 5 is a sectional view taken along line 5—5 of FIG. 2.

During normal operation, inner splined portion 37, FIG. 4, of second clutch member 36 drivingly engages propeller shaft 24 at splined portion 26 and is forward biased into first clutch member 34, FIG. 2, by helical spring 38 which is compressed by washer 40 and retaining nut 42. Clutch teeth 50 of second clutch member 36 drivingly engage clutch sockets 46 of first clutch member 34 to drive first clutch member 34 which is fixed to and drives propeller hub 20. Retaining nut 42 and washer 40 compress helical spring 38 to forward bias the teeth 50 of first clutch member 36 into the sockets 46 of second clutch member 34 such that torque is transferred from propeller shaft 24 through first and second clutch members 34, 36 to propeller hub 20. In this manner, helical spring 38 does not transfer torque and therefore does not experience the torsional torque losses associated with prior attempts to clutch the propeller to the propeller shaft.

Figure 6:
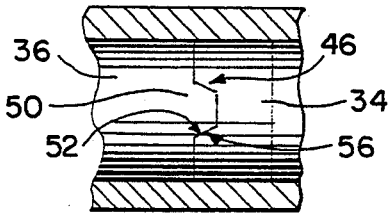
FIG. 6 is a partial top plan view of the clutch members with the propeller hub in section, taken along line 6—6 of FIG. 2.

When propeller 18, FIG. 1, strikes an obstacle, clutch teeth 50, FIGS. 3 and 6, begin to disengage clutch sockets 46 by way of the clutch teeth sidewalls 52 sliding up the clutch socket sidewalls 56. If the torque required to overcome the obstacle is greater than the torque required to disengage clutch teeth 50 from clutch sockets 46, referred to as the disengagement torque, propeller hub 20 is then freed from the driving engagement of propeller shaft 24 to allow propeller shaft 24 to continue rotation independent of propeller 18, FIG. 1. When the torque of the propeller shaft 24, FIG. 2, is reduced below the disengagement torque, or if the propeller blades are freed from the object, second clutch member 36 reengages first clutch member 34 by the forward biasing spring compression force of helical spring 38.

The level of torque to freely rotate propeller hub 20 with respect to propeller shaft 24 is determined not only by the size of helical spring 38 and the amount of spring compression provided by retaining nut 42, but also by the angles of extension 54, 58, FIG. 3. For example, if the angles of extension 54, 58 are increased, less torque would be required to disengage clutch teeth 50 from clutch sockets 46. Conversely, if the angles of extension 54, 58 were decreased, the torque required to disengage clutch teeth 50 from clutch sockets 46 would be increased. Further, the height of clutch teeth 50 and the depth of clutch sockets 46 also contribute to determining the torque required to induce the clutch to disengage. For example, if clutch teeth 50 are made longer, and clutch sockets 46 are made correspondingly deeper, more torque would be required to disengage clutch teeth 50 from clutch sockets 46. Conversely, if clutch teeth 50 are made shorter and clutch sockets 46 are made shallower, less torque would be required to disengage the clutch. Preferably, the torque required to disengage the clutch is set to a level just below that which would cause damage to the marine drive.

The amount of spring compression may also be adjustable by using an adjustable retaining nut, for example a lock nut. In this manner, the torque required to rotate propeller hub 20 with respect to propeller shaft 24, is adjustable.

To allow for wear and lessen the cost of future replacement, first clutch member 34 and second clutch member 36 are made of different materials such that one of the clutch members accepts the wear associated by the reoccurring engagement and disengagement of the clutch. In the preferred embodiment, second clutch member 36 is comprised of a softer material than first clutch member 34 because second clutch member 36 is rearward of first clutch member 34 and is easily replaced by removing retaining nut 42, washer 40, helical spring 38, and sliding propeller hub 20 rearward to disengage second clutch member 36 from the splined relation with propeller shaft 24. In this manner, the clutch assembly is easily repairable by replacing the propeller hub on the propeller shaft, sliding a new second clutch member 36 on splined portion 26 of propeller shaft 24, reinserting helical spring 38, washer 40, and retaining nut 42.

The propeller clutch of the present invention is readily adaptable to existing marine drives by either replacing the propeller hub with a propeller hub having the clutch therein, or by altering the existing propeller hub to accommodate the clutch members and helical spring.

The present invention includes a method for releasing a propeller on a marine drive from the driving engagement of a propeller shaft to protect the marine drive when the propeller hits an object with sufficient force to otherwise cause damage to the marine drive. Referring to FIG. 2, the method comprises disengagably driving propeller 18 to propeller shaft 24. The method is free of the torsional losses associated with transferring torque through a compression spring and is also free of the inherent slip associated with using friction pads to transfer torque. The method provides for nonslip directed drive during normal operation but allows free propeller shaft rotation when the propeller is stopped by an obstacle. The free rotation is provided by disengaging the propeller 18 from the propeller shaft 24. The method also comprises a step of providing reengagement of the propeller to the propeller shaft once the propeller is free from the obstacle. The reengagement renews the nonslip direct drive between the propeller and the propeller shaft.

It is recognized that various equivalents, alternatives, and modifications are possible within the scope of the appended claims.

I claim:

1. A marine drive comprising a propeller having a propeller hub with a central passage extending axially therethrough and having an open aft end;

a propeller shaft extending axially rearwardly through said passage and having a threaded aft end with a propeller mounting nut attached thereto;

a propeller clutch comprising forward and rearward clutch members in said passage having mating clutch sockets and teeth, one of said clutch members being drivingly engaged by said propeller shaft, the other of said clutch members drivingly engaging said propeller hub;

a helical compression spring extending axially in said passage, said spring having a forward end bearing against said rearward clutch member, said spring having an aft end bearing against said mounting nut, such that said spring is accessible and axially slidable rearwardly through said open aft end of said propeller hub upon removal of said mounting nut.

2. The invention according to claim 1 wherein said rearward clutch member is drivingly engaged by said propeller shaft, and said forward clutch member drivingly engages said propeller hub.

3. The invention according to claim 2 wherein said rearward clutch member is comprised of a softer material than said forward clutch member and accepts wear faster than said forward clutch member, said rearward clutch member being removable from said propeller hub without removing said forward clutch member.

4. The invention according to claim 1 wherein said rearward clutch member is splined to and drivingly engaged by said propeller shaft, said forward clutch member is fixed to said propeller hub, such that upon removal of said mounting nut, said propeller hub is axially slidable rearwardly to break the splined engagement of said rearward clutch member and said propeller shaft, and to axially push said spring rearwardly off of said propeller shaft if not previously removed.

* * * * *